US006382310B1

(12) United States Patent
Smith

(10) Patent No.: US 6,382,310 B1
(45) Date of Patent: May 7, 2002

(54) STEPPED HEAT EXCHANGER COILS

(75) Inventor: Sean A. Smith, La Crosse, WI (US)

(73) Assignee: American Standard International Inc., New York, NY (US)

( * ) Notice: Subject to any disclaimer, the term of this patent is extended or adjusted under 35 U.S.C. 154(b) by 0 days.

(21) Appl. No.: 09/638,347

(22) Filed: Aug. 15, 2000

(51) Int. Cl.[7] ..... F28F 9/26

(52) U.S. Cl. ..... 165/121; 165/146; 165/150; 165/144; 165/139

(58) Field of Search ..... 165/146, 150, 165/139, 110, 144, 121; 62/526

(56) References Cited

U.S. PATENT DOCUMENTS

| | | | | | |
|---|---|---|---|---|---|
| 485,315 | A | * | 11/1892 | Yaryan | 165/146 X |
| 1,073,746 | A | * | 9/1913 | Dwyer | 165/146 |
| 1,636,521 | A | * | 7/1927 | Ljungstrom et al. | 165/146 |
| 2,423,997 | A | * | 7/1947 | Ruegg | 165/144 X |
| 4,053,014 | A | * | 10/1977 | Neff et al. | 165/150 |
| 4,089,368 | A | * | 5/1978 | Bell, Jr. et al. | 165/139 |
| 4,165,783 | A | * | 8/1979 | Oplatka | 165/146 X |
| 4,520,867 | A | | 6/1985 | Sacca et al. | |
| 4,831,844 | A | * | 5/1989 | Kadle | 165/150 X |
| 4,995,453 | A | * | 2/1991 | Bartlett | 165/150 |
| 5,056,594 | A | | 10/1991 | Kraay | |
| 5,067,560 | A | | 11/1991 | Carey et al. | |
| 5,138,844 | A | | 8/1992 | Clanin et al. | |
| 5,810,074 | A | | 9/1998 | Hancock | |

FOREIGN PATENT DOCUMENTS

| | | | | |
|---|---|---|---|---|
| DE | 3536325 | * | 5/1986 | 165/150 |
| JP | 6-199128 | * | 7/1994 | 165/146 |

OTHER PUBLICATIONS

Applicant's Engineering Drawing A667235, entitled "Return Bend", dated Oct. 17, 1997.

Applicant's Engineering Drawing A666221, entitled "Return Bend", dated Oct. 31, 1996.

Applicant's Drawing X17180236, entitled "U–Bend", dated Aug. 9, 1994.

* cited by examiner

*Primary Examiner*—Leonard Leo
(74) *Attorney, Agent, or Firm*—William J. Beres; William O'Driscoll

(57) ABSTRACT

A heat exchanger comprising: a plurality of longitudinally extending tubes grouped into at least first, second and third passes; the tubes in the first pass being serially connected with tubes in the second pass; the tubes in the second pass being serially connected with tubes in the third pass; and wherein the number of tubes in the first pass is greater than the number of tubes in the third pass.

6 Claims, 12 Drawing Sheets

FIG. 6A
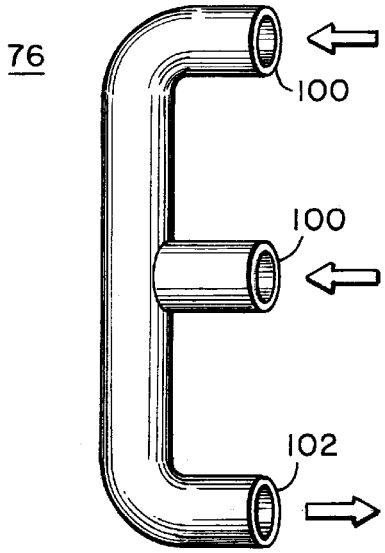
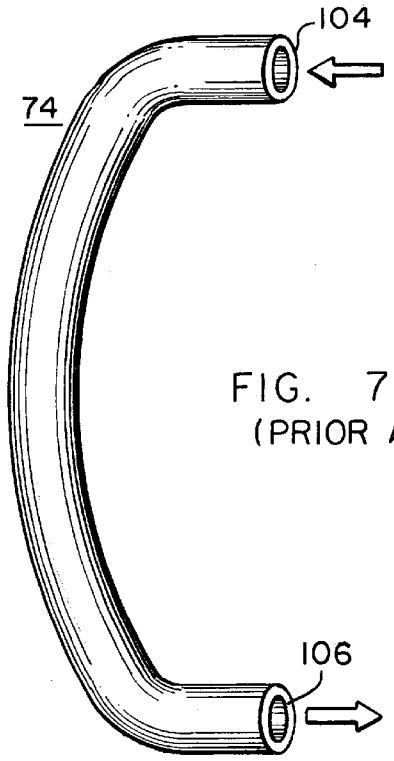
FIG. 7
(PRIOR ART)
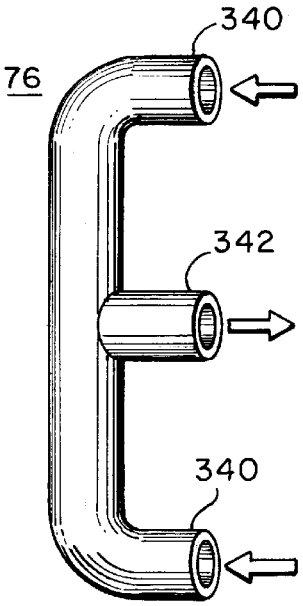
FIG. 6B
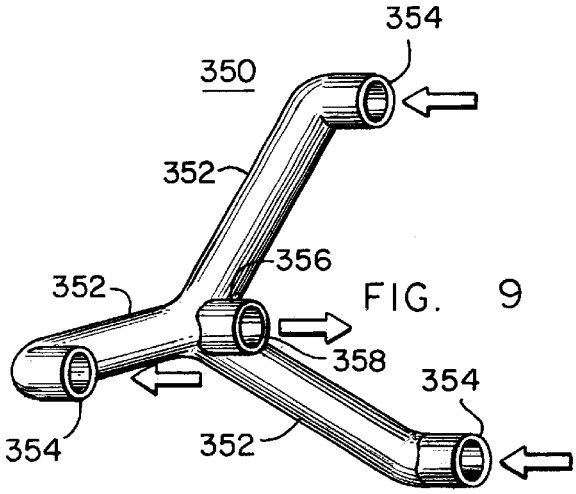
FIG. 9
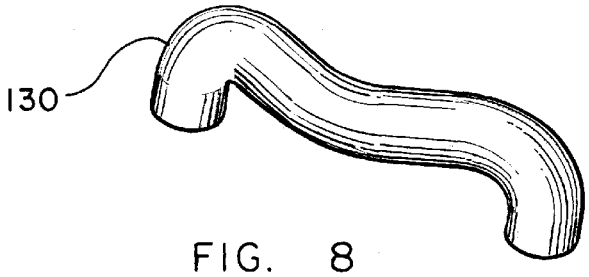
FIG. 8

STEPPED HEAT EXCHANGER COILS

BACKGROUND OF THE INVENTION

The present invention is directed to heat exchangers for heating, ventilating and air conditioning (HVAC) and refrigeration applications. More specifically, the present invention proposes an arrangement for circuiting the passages of the heat exchanger to improve the heat exchanger's performance. The improved arrangement, defined as step circuiting for purposes of this application, allows a heat exchanger to be designed with an increased number of circuits in the first pass and a reduced number of circuits in subsequent passes.

The increased number of circuits in the first pass reduces the pressure drop throughout the heat exchanger. This becomes important with lower density refrigerants such as R134*a* and also becomes important as the diameter of passages within the heat exchanger are reduced. Additionally, a reduced number of circuits in subsequent passes allows the heat transfer coefficient to increase due to the higher velocity of the refrigerant within the coils. The combination of lowering the entering pressure drop and increasing the overall heat transfer coefficient produces a more effective heat exchanger.

Additionally, most units require a middle header to collect the liquid leaving a condensing heat exchanger and directed to the inlet of a subcooler portion of that heat exchanger. The present invention also proposes to apply the step circuiting throughout a condensing heat exchanger and continue it through the subcooler to thereby eliminate the middle header.

SUMMARY OF THE INVENTION

The present invention is intended to address and solve the problems of the prior art.

The present invention is directed to a heat exchanger including a stepped coil. It is an object, advantage and feature of the present invention to apply the use of the step coil throughout a condensing heat exchanger including the subcooler.

It is an object, feature and advantage of the present invention to eliminate at least one of the headers of a heat exchanger and thereby provide easier and improved manufacturing.

It is an object, feature and advantage of the present invention to eliminate a header on a condensing heat exchanger to thereby reduce the total number of joints with a subsequent reduction in potential leak sites.

It is an object, feature and advantage of the present invention to provide a three fingered e-bend. It is a further object, feature and advantage of the present invention to replace a middle header with this e-bend and thereby lower the cost to manufacture a heat exchanger.

It is an object, feature and advantage of the present invention to lower the pressure drop in the critical first pass of a heat exchanger. It is a further advantage and improvement of the present invention to increase the velocity and therefore the heat transfer coefficient in each subsequent pass of the heat exchanger. It is a further feature and advantage of the present invention to move a subcooling portion to the front of the heat exchanger so that cooler, rather than warmer, air flows across it, and to thereby improve performance. It is a further object, feature and advantage of the present invention to move the outlet of a heat exchanger from a bottom portion of the heat exchanger to a mid-portion and thereby facilitate the manufacturing of the heat exchanger.

It is an object, feature and advantage of the present invention to provide a heat exchanger having tubes arranged in patterns where each pattern is repeated a predetermined number of times to form the heat exchanger.

It is an object, feature and advantage of the present invention to provide a connector between the passes of the a heat exchanger where the connector has multiple inlets and single outlet. It is a further object, feature and advantage of the present invention that this connector have the shape of a capital "E".

It is an object, feature and advantage of the present invention to provide a pattern of passes in a heat exchanger where each pattern includes at least three passes and where each pattern is replicated to form the heat exchanger.

It is an object, feature and advantage of the present invention to reduce the number of tubes in each pass as fluid travels from the inlet to the outlet of the heat exchanger.

The present invention provides a heat exchanger including a first fluid to be cooled, a second fluid cooling the first fluid, and a containment structure containing the first fluid and including heat transfer elements in heat exchange relation with the second fluid. The structure also includes an inlet, an outlet, a face, and a first pattern set where the first pattern set includes first and second respective passages extending across the face and linearly connected to each other, the inlet, and the outlet. The number of first passages is greater than the number of second passages. The heat exchanger also includes a connector interconnecting the first passages with the second passages wherein the connector includes multiple inlets and a single outlet. The connector preferably has the shape of a capital The present invention also provides a method of manufacturing a heat exchanger. The method comprises the steps of: forming a pattern set to control movement of a first fluid through a heat exchanger; providing multiple passes in each pattern set, and assembling a heat exchanger using multiples of the pattern set. Each pass includes one or more tubes. The number of tubes in each pass is less than or equal to the number of tubes in the previous pass as the distance from the inlet of the heat exchanger increases. The number of tubes in an initial pass is greater than the number of tubes in a final pass.

The present invention additionally provides a heat exchanger arrangement including a pattern of passes in a heat exchanger. Each pattern includes at least three passes, and each pass includes one or more tubes extending across a face of the heat exchanger. The number of tubes in a given pass is less than or equal to the number of tubes in a previous pass and the heat exchanger includes at least two passes with differing numbers of tubes.

The present invention further provides a heat exchanger including a plurality of longitudinally extending tubes grouped into at least first, second and third passes. The tubes in the first pass are serially connected with tubes in the second pass. The tubes in the second pass are serially connected with tubes in the third pass. The number of tubes in the first pass is greater than the number of tubes in the third pass. The heat exchanger also preferably includes an E-shaped connector located between the tubes of two different passes.

The present invention yet further provides an air cooled heat exchanger including a frame and a longitudinally extending heat exchanger surface arranged in the frame and supported thereby. The heat exchanger has an inlet, an outlet, and a plurality of parallel tubes having an inlet and an outlet and arranged in a pattern set. The heat exchanger also includes a fan moving air through the heat exchanger surface, a manifold distributing fluid from the inlet to the first pass set, and a first pass of tubes in the pattern set an inlet and an outlet. The heat exchanger includes a second pass of tubes in the pattern set in, and a third pass of tubes in the pattern set. Connectors transfer fluid from the outlets of the first pass to the inlets of the second pass, and from the outlets of the second pass to the inlets of the third pass. The number of tubes in the first pass is greater than or equal to the number of the tubes in the second pass and the number of tubes in the second pass is greater than or equal to the number of tubes in the third pass. The number of tubes in the first pass is greater than the number of tubes in the third pass.

The present invention yet further provides a tubular connector. The connector comprises at least a pair of inlet arms each having an inlet aperture; an outlet arm having an outlet aperture; and a body operatively connecting the inlet arms and the outlet arms. Preferably, the inlet arms and the outlet arms lie in a common plane, and the inlet arms and the outlet arm are parallel such that the inlet arms, the outlet arm and the body are arranged in an E-shape.

BRIEF DESCRIPTION OF THE DRAWINGS

FIG. 3A represents single pattern set taken from FIG. 2 along lines 3A; where FIG. 3B represents a graph of the number of tubes per passes versus the number of passes in this embodiment; where FIG. 3C is a diagram showing the pattern set of FIG. 3A in a different format; where FIG. 3D shows the entire twelve pattern sets that make up the heat exchanger of this embodiment with a Roman Numeral identifying each individual identical pattern set; and where FIG. 3E represents patterns sets II, III and IV of FIG. 3D and as taken along lines 3E of FIG. 2.

FIG. 4A represents single pattern set taken from FIG. 2 along lines 4A; where FIG. 4B represents a graph of the number of tubes per passes versus the number of passes in this embodiment; where FIG. 4C is a diagram showing the pattern set of FIG. 4A in a different format; where FIG. 4D shows the entire twelve pattern sets that make up the heat exchanger of this embodiment with a Roman Numeral identifying each individual identical pattern set; and where FIG. 4E represents patterns sets II, III and IV of FIG. 4D and as taken along lines 4E of FIG. 2.

FIG. 5A represents single pattern set taken from FIG. 2 along lines 5A; where FIG. 5B represents a graph of the number of tubes per passes versus the number of passes in this embodiment; where FIG. 5C is a diagram showing the pattern set of FIG. 3A in a different format; where FIG. 5D shows the entire twelve pattern sets that make up the heat exchanger of this embodiment with a Roman Numeral identifying each individual identical pattern set; and where FIG. 5E represents patterns sets III and IV of FIG. 5D and as taken along lines 5E of FIG. 2.

FIGS. 6A and B show first and second embodiments of an E-bend connector having a multiple set of inlets and a single outlet in accordance with the present invention.

FIG. 7 shows a prior art U-bend connector.

FIG. 8 shows a twisted connector used in the present invention.

FIG. 9 shows an alternative embodiment of the connector of FIG. 6.

DETAILED DESCRIPTION OF THE DRAWING

Figure 1:
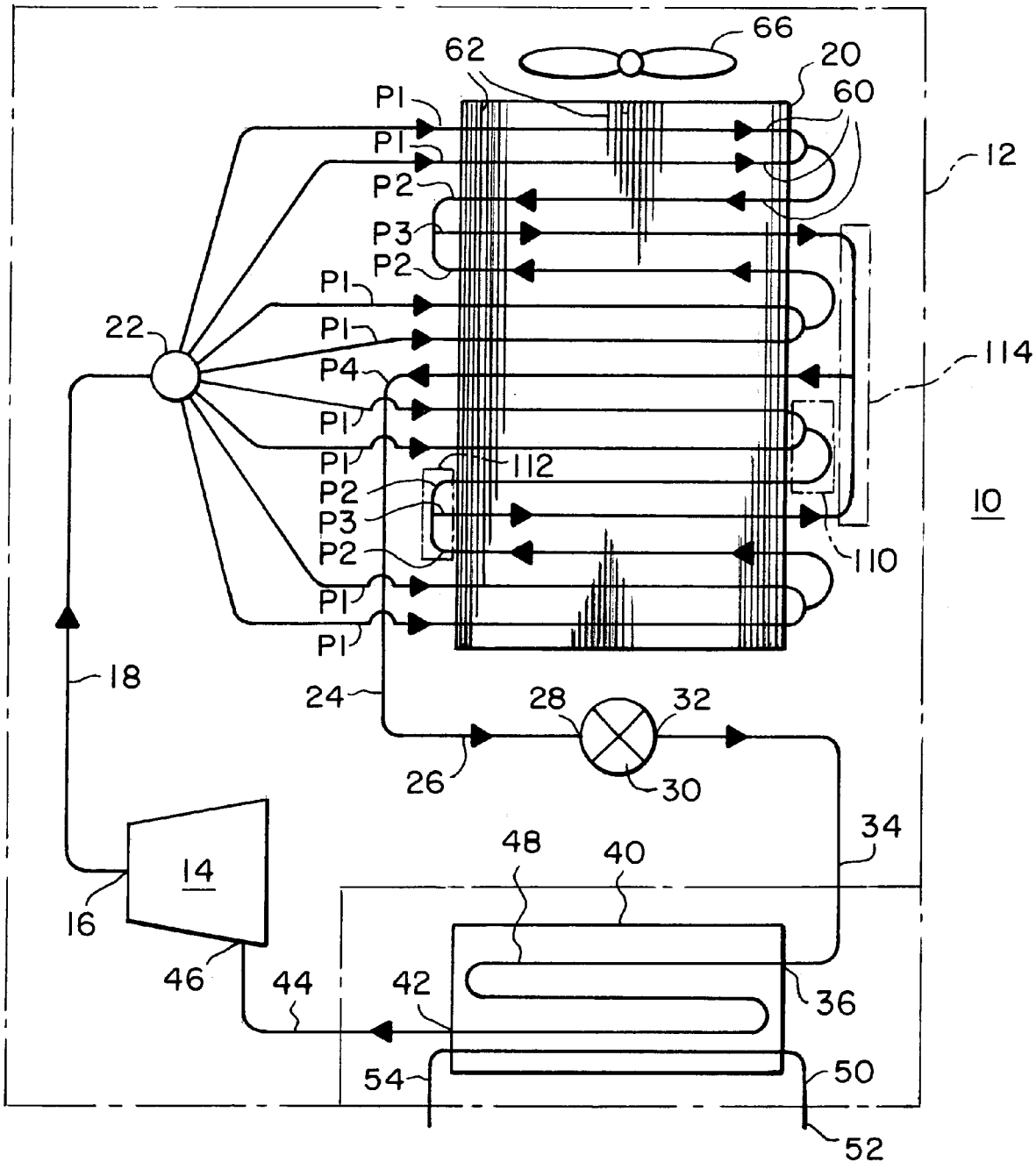
FIG. 1 shows a block diagram of an air conditioning or refrigeration system in accordance with the present invention.
Figure 2:
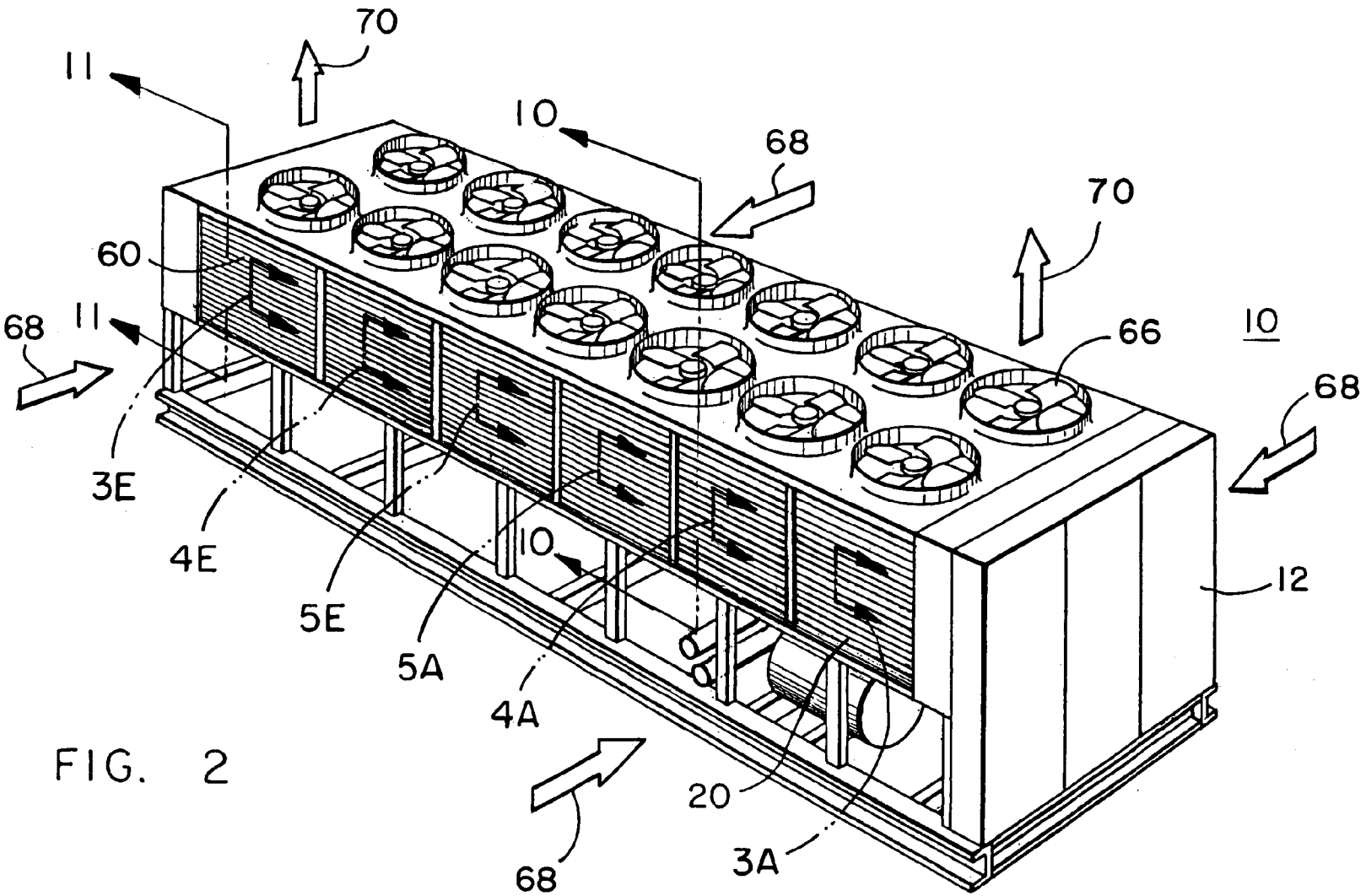
FIG. 2 is a perspective viewpoint of an air cooled air conditioning or refrigeration system such as the system of FIG. 1.

The present invention is directed to an improved heat exchanger, preferably of an air cooled condenser type 20 such as in FIGS. 1 and 2. However, although described in terms of an air cooled condenser, the present invention is applicable to other types of heat exchangers where a fluid passes around the outside of conduit such as heat exchanger tubes containing a refrigerant. Additionally, the present invention is described in terms of mechanical refrigeration systems which use a compressor 14 but is also applicable to non-mechanical refrigeration systems such as absorption refrigeration systems. Exemplary absorption refrigeration systems are sold by applicant under the trademarks Horizon and Cold Generator, while other exemplary mechanical refrigeration systems are sold by applicant under the trademarks Series R, 3D and CenTraVac.

FIGS. 1 and 2 show an air conditioning, HVAC or refrigeration system 10. The system 10 is preferably contained within an enclosure 12 and includes the compressor 14 having an outlet 16 serially linked by conduit 18 to the condenser 20 at a condenser inlet 22. The condenser 20 has an outlet 24 linked by conduit 26 to the inlet 28 of an expansion device 30. The expansion device 30 is preferably an electronic expansion valve, but may also be implemented as an orifice, a capillary tube, a thermal expansion valve, or other conventional device for throttling refrigerant.

The expansion device 30 includes an outlet 32 connected by conduit 34 to an inlet 36 to an inside heat exchanger such as an evaporator 40. The evaporator 40 has an outlet 42 connected by conduit 44 to an inlet 46 of the compressor 14. The evaporator 40 has internal heat transfer elements 48 in heat transfer relationship with the fluid to be cooled contained in a chiller loop 50. The chiller loop 50 has an entering fluid inlet 52 and a leaving fluid outlet 54. The evaporator 40 can be implemented conventionally as a shell and tube, falling film, plate, fin and tube, or other type of heat exchanger.

The condenser 20 is preferably an air cooled condenser having a plurality of tubes 60 in heat transfer relationship with an enhanced surface 62 such as a plate fin. A conventional fan 66 moves air across the tubes 60 and the element 62 as indicated by airflow arrows 68 and 70 of FIGS. 1 and 2. Representative systems are sold by applicant under the trademark Series R and elements of those systems are shown in applicant's commonly assigned U.S. Pat. Nos. 5,067,560 to Carey; 5,056,594 to Kraay; and 5,138,844 to Clanin et al., these patents being incorporated by reference.

The present invention is directed to a stepped circuiting arrangement in a heat exchanger. In a stepped circuit, the number of tubes in a first pass of tubes is large in order to reduce pressure drop, while the number of tubes in subsequent passes is reduced to increase velocity of fluid in the tubes and increase the heat transfer coefficient. This is shown by example in FIG. 1 where the condenser 20 passes refrigerant across its face in four passes P1, P2, P3 and P4. The condenser 20 has eight tubes P1 in the first pass of refrigerant through the condenser 20 and across its face, four tubes P2 in a second pass through the condenser 20 and across its face, a pair of tubes P3 in a third pass and across its face, and a single tube P4 in a fourth pass.

In the heat exchanger of FIG. 1, there are three steps, from P1 to P2, from P2 to P3, and from P3 to P4. The first pass P1 has the number of its tubes reduced in half to form a first step down in the number of tubes reaching the second pass P2. The second pass P2 has the number of its tubes reduced in half to form a second step down in the number of tubes reaching the third pass P3. The third pass P3 has the number of its tubes reduced in half to form a third step down in the number of tubes reaching the fourth pass P4. For purposes of this application, the physical arrangement of the tubes in forming each pass and the overall grouping of the passes is defined as a patterned set.

Figure 3A:
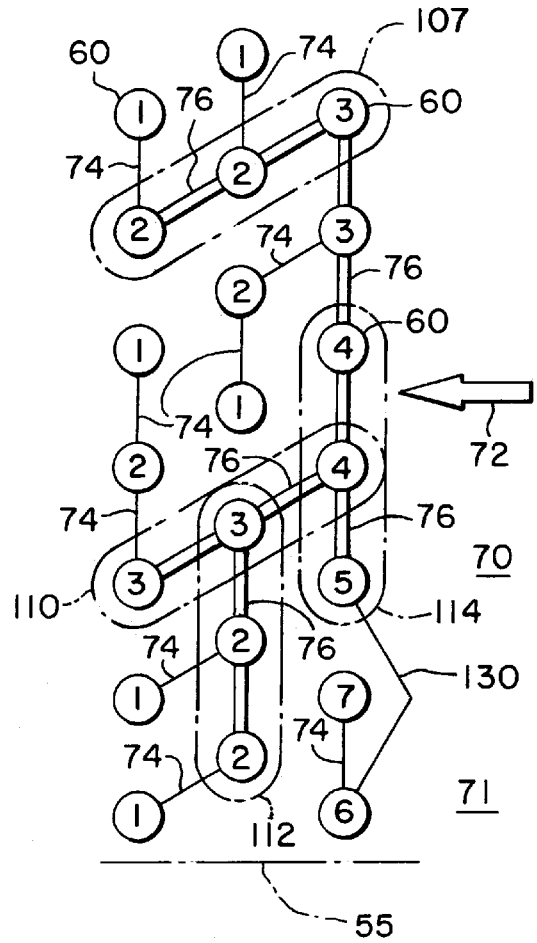
FIGS. 3A–3E represent a first embodiment of the present invention with seven refrigerant passes, where
Figure 3B:
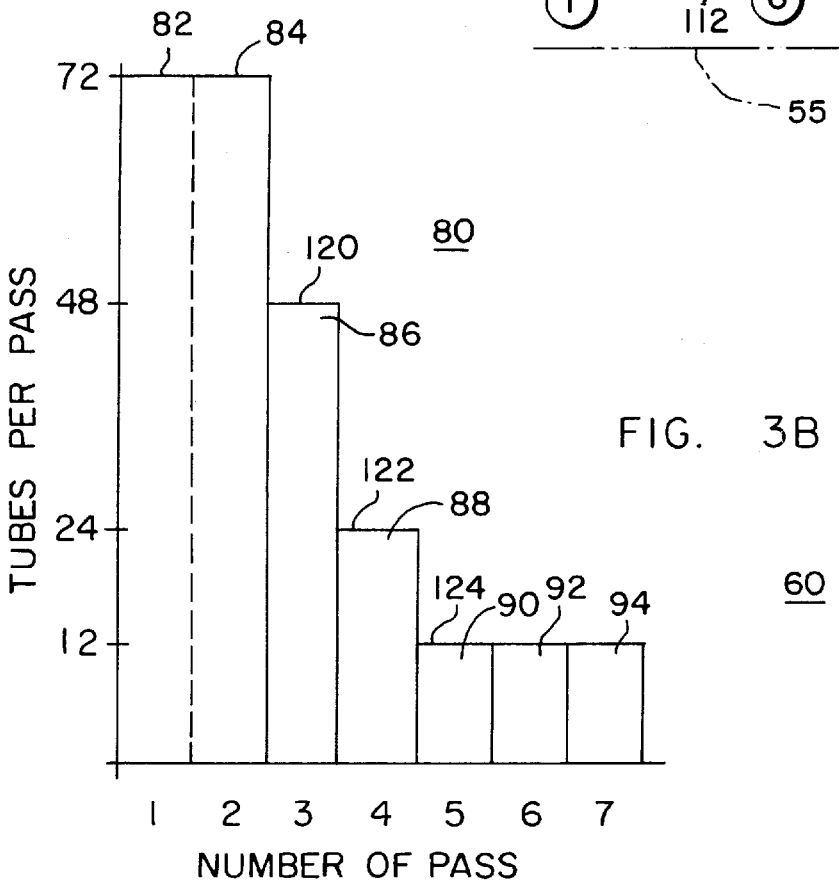
Figure 3C:
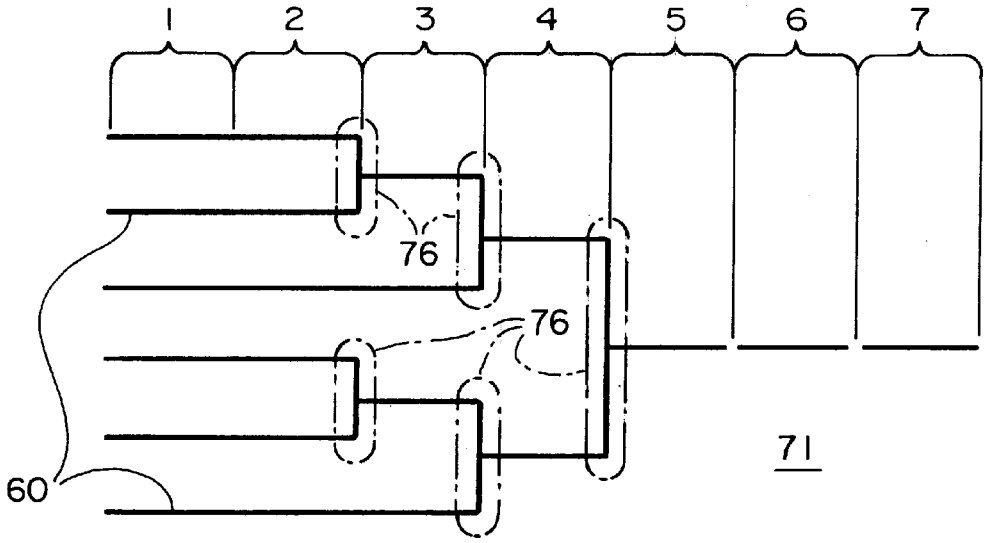
Figure 4C:
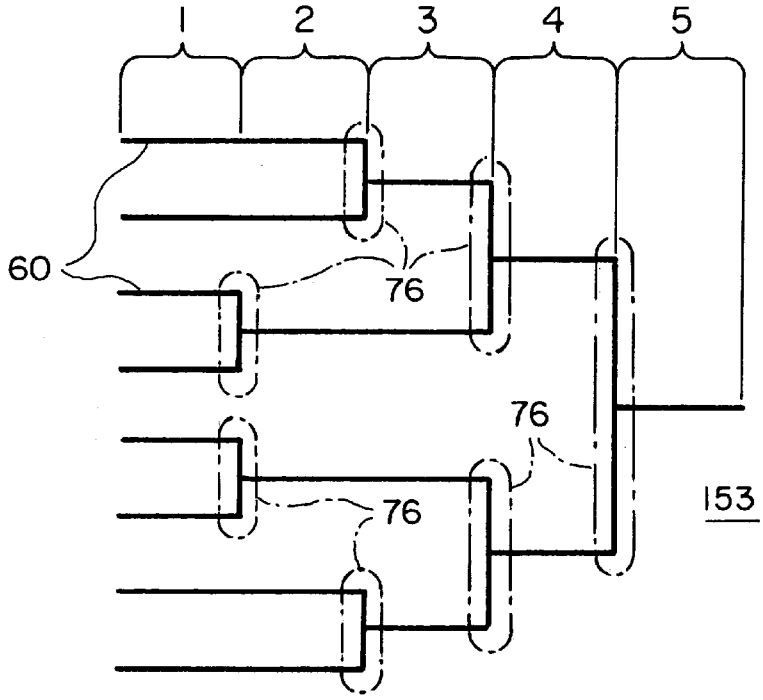
FIGS. 4A–4E represent a second embodiment of the present invention with five refrigerant passes where
Figure 3D:
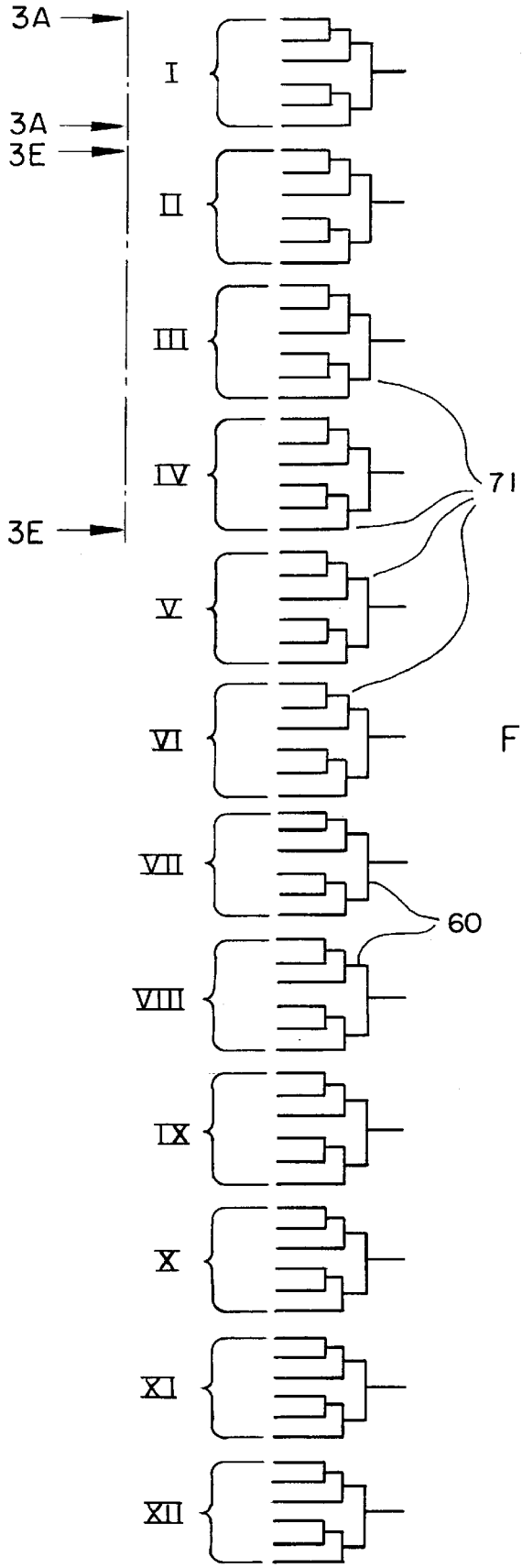
Figure 3E:
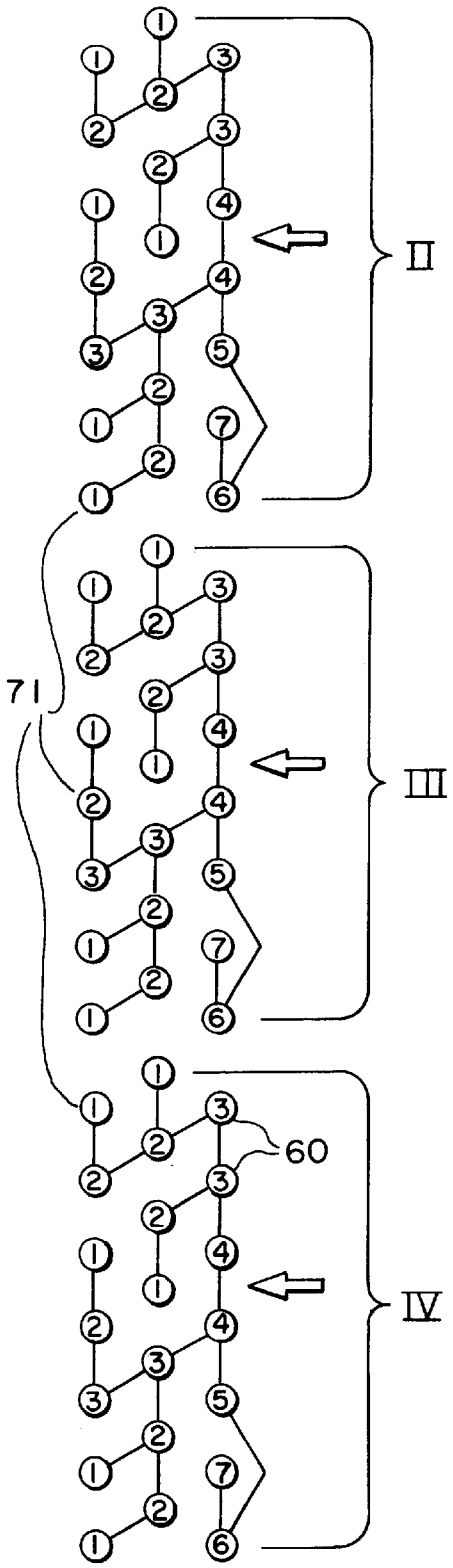
Figure 4E:
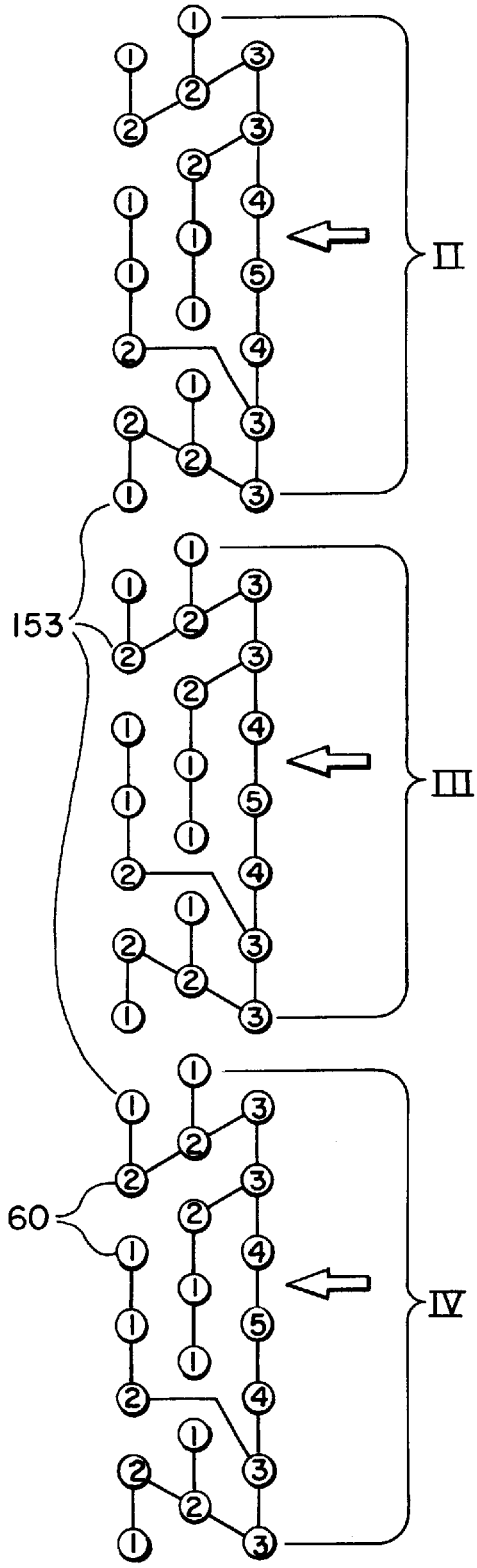
Figure 4A:
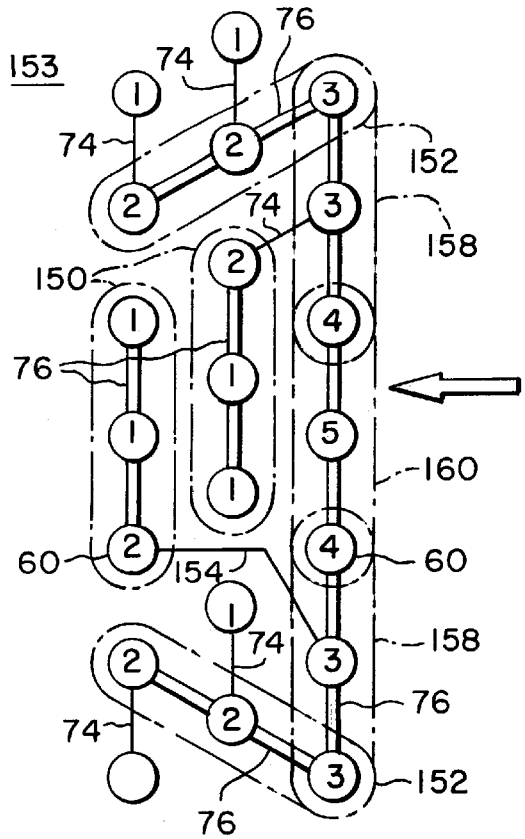
Figure 4B:
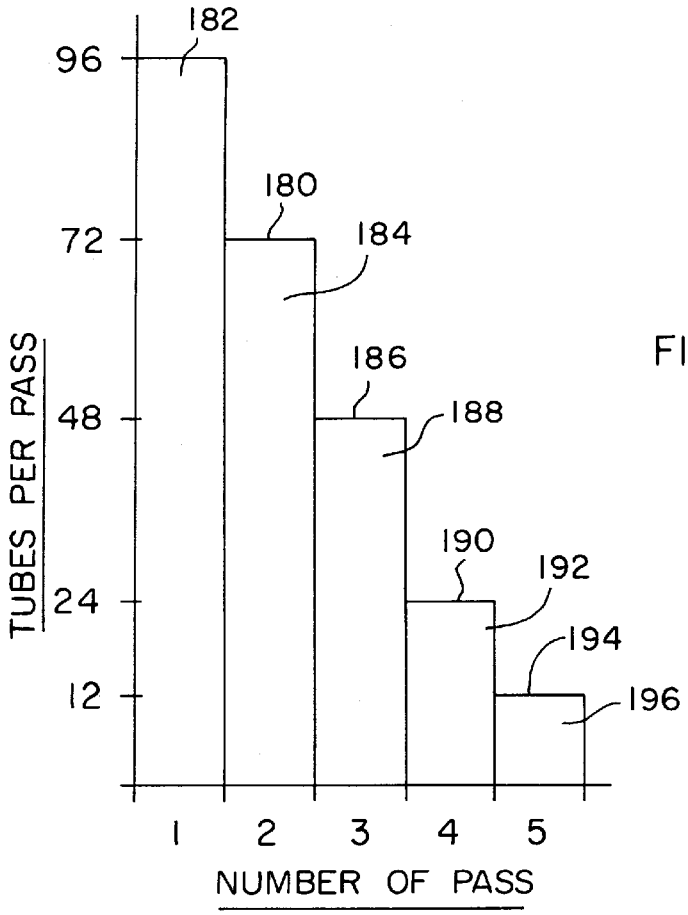
Figure 4D:
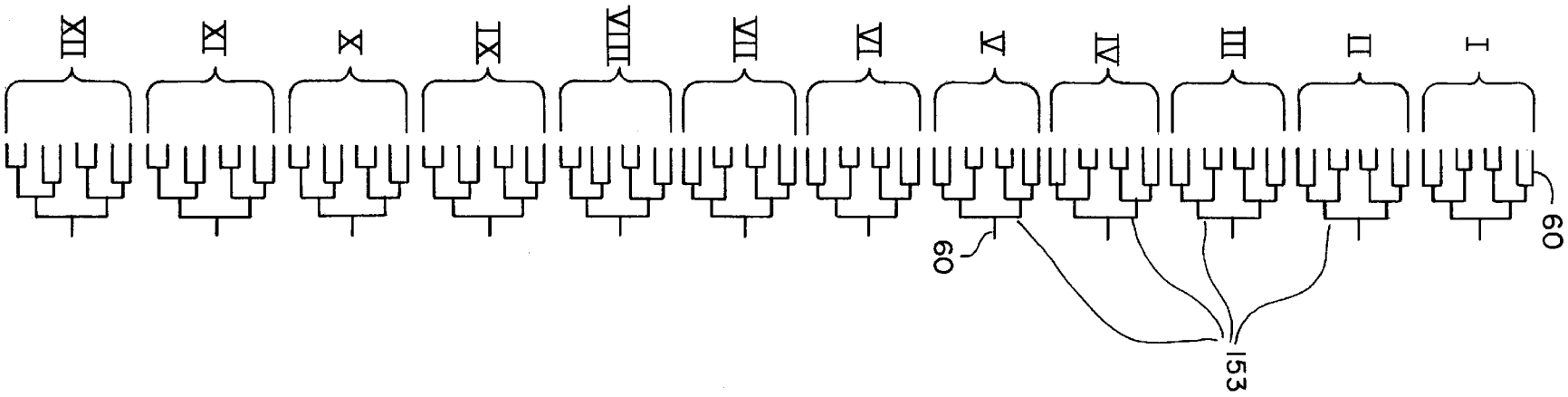
Figure 5A:
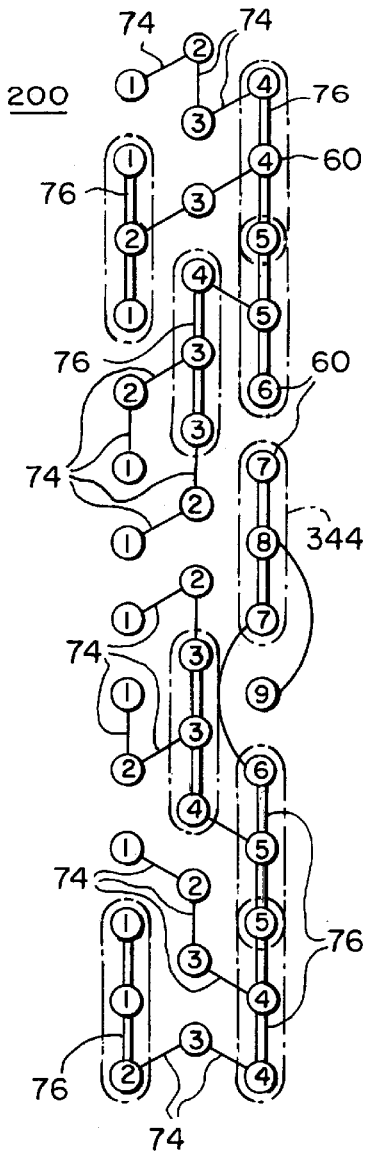
FIGS. 5A–5E represent a third embodiment of the present invention with nine refrigerant passes where
Figure 5C:
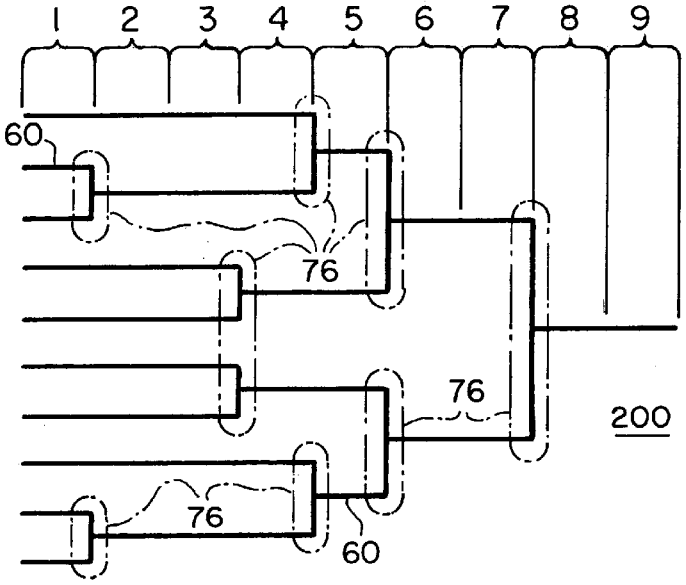
Figure 5B:
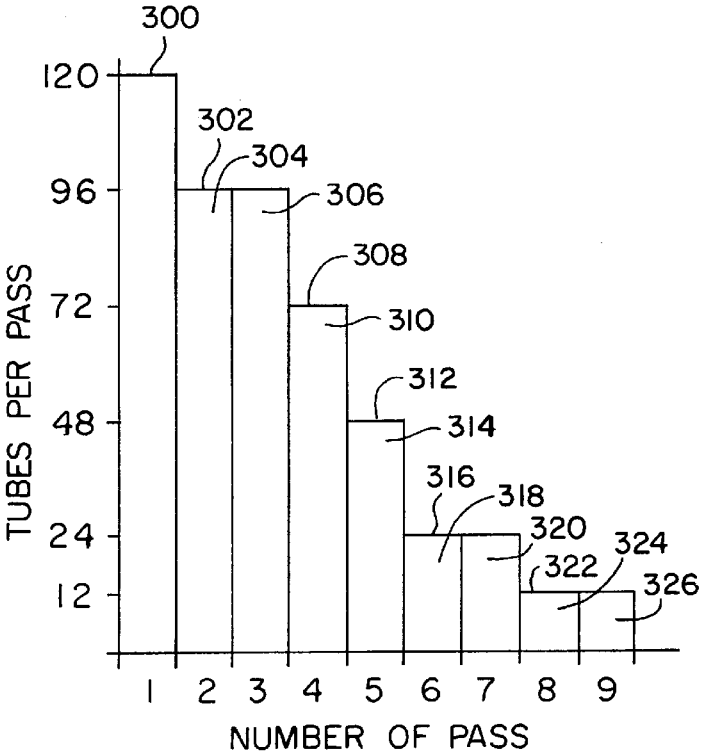
Figure 5D:
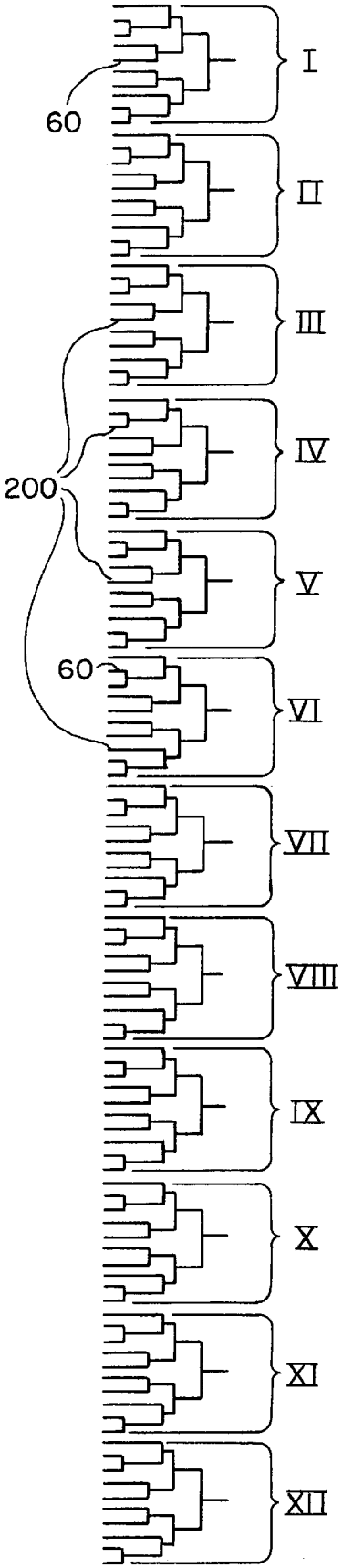
Figure 5E:
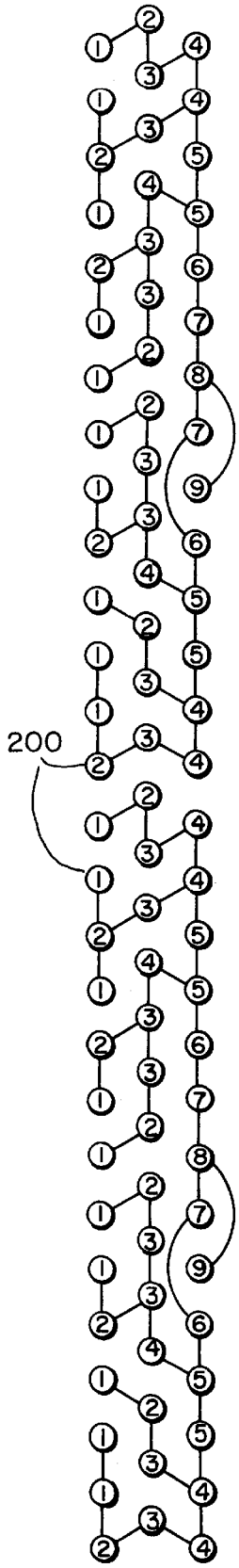

FIGS. 3A–3E represent a first embodiment of the present invention with seven refrigerant passes, FIGS. 4A–4E represent a second embodiment of the present invention with five refrigerant passes, and FIGS. 5A–5E represent a third embodiment of the present invention with nine passes. FIG. 3A, FIG. 4A and FIG. 5A represent single pattern sets taken from FIG. 2 along respective lines 3A, 4A and 5A. FIGS. 3B, 4B and 5B represent graphs of the number of tubes per passes versus the number of passes in the particular embodiment. FIGS. 3C, 4C and 5C are diagrams showing the pattern set of respective FIGS. 3A, 4A and 5A in a different format. FIGS. 3D, 4D and 5D show the entire pattern sets that make up the heat exchanger of the particular embodiment with a Roman Numeral identifying each individual identical pattern set. FIGS. 3E, 4E and 5E represent patterns sets of FIG. 3D as taken along respective lines 3E, 4E and 5E of FIG. 2.

Each of FIGS. 3A, 4A and 5A presents a single pattern set of a preferred embodiment of the present invention. FIG. 3A presents a pattern set 71 for a seven pass heat exchanger, FIG. 4A presents a pattern set 153 for a five pass heat exchanger, and FIG. 5A represents a pattern set 200 for a nine pass heat exchanger. The number of passes indicates the number of times (or tubes) that the refrigerant traverses the face of the heat exchanger. Although all of these embodiments are shown on the condenser 20 of FIG. 2, for ease of manufacturing it is preferred that one embodiment be implemented throughout a particular heat exchanger.

Each embodiment of FIGS. 3A, 4A and 5A is viewed along the axis of tubes 60 as shown by respective lines 3A, 4A and 5A of FIG. 2. Additionally, each tube 60 is shown enclosing a number indicating the pass in which refrigerant fluid is travelling within it. For instance, a tube 60 enclosing the number 1 indicates refrigerant in pass 1, a tube 60 enclosing the number 2 indicates refrigerant in pass 2, and so on.

As indicated, FIG. 3A shows a single pattern set 71 for a seven pass tube arrangement. Refrigerant in the tubes 60 will traverse the longitudinal width of the heat exchanger 20 seven times. In applicant's preferred seven pass embodiment as shown in FIG. 3D, a heat exchanger includes twelve identical pattern sets (numbered Roman Numerals I–XII).

FIG. 3A shows the single pattern set 71 with airflow entering from the direction indicated by arrow 72. Refrigerant initially enters the six tubes 60 indicated by enclosing the number 1 as carrying a refrigerant in the first pass and traverses the face of the heat exchanger within these tubes 60. Depending on the arrangement, either a U-bend connector 74 having a single inlet 104 and a single outlet 106 (see FIG. 7) or an E-bend connector 76 having a pair of inlets 100 and a single outlet 102 (see FIGS. 6A and 6B) transfers the refrigerant from the end of one pass to the beginning of the next pass. In the example given in FIG. 3A, U-bends 74 transfer refrigerant from all six tubes in the first pass to the six tubes in the second pass.

FIG. 3B is a graph of the number of tubes per pass as related to the number of passes. Each pattern set 71 is replicated twelve times as indicated in FIG. 3D to form the preferred seven pass heat exchanger. Thus, in the seven pass embodiment of FIGS. 3A-E, each pattern set 71 has six tubes in its first pass, while the entire first pass includes seventy-two tubes as indicated by area 82 of the bar chart 80. The one-to-one correspondence of the first pass tubes to the second pass tubes is indicated by the area 84. The area 86 indicates that the entire third pass of the heat exchanger has 48 tubes, and the area 88 shows that the entire fourth pass has 24 tubes. The fifth, sixth and seventh passes of the heat exchanger each have 12 tubes as indicated by the areas 90, 92 and 94 respectively. Since these areas 82, 84, 86, 88, 90, 92, 94 show the total number of tubes in that pass for the entire heat exchanger and since there are 12 identical pattern sets 71 in the heat exchanger, it is clear that each individual pattern set 71 has a single tube in passes five through seven, a pair of tubes in pass four, and four tubes in pass three.

This is accomplished through the use of the E-bend connectors 76 of FIGS. 6A or 6B which have a pair of inlets 100 and a single outlet 102. This is in contrast to the prior art U-bend connector 74 of FIG. 7 which has a single inlet 104 and a single outlet 106.

Referencing a specific E-bend connector 107 of FIG. 3A, the output of a pair of second passes are combined by an E-bend connector 76 and directed to the third pass to thereby increase the velocity of the refrigerant in the tube 60 of the third pass. It should be recognized that the connectors 74, 76 are provided to connect each tube outlet with a tube inlet of the next pass. The heat exchanger is a closed system such that a connector 74, 76 will be followed by a connector 74, 76 at an opposite end of the face of the heat exchanger. The opposite end connector 74, 76 will in turn be followed by another connector 74, 76 at the original end and usually in general proximity to the original connector (see FIG. 1).

In FIG. 3A, four of the second pass tubes are combined into a pair of third pass tubes, two of the second pass tubes remain uncombined and thus lead directly to a single third pass tube from a single second pass tube. This results in a step 120 as shown on the graph 3B from the seventy-two tubes of the second pass to the forty-eight tubes of the third pass. Since there are now four tubes in the third pass of the pattern set 71 and since there are twelve pattern sets, forty-eight tubes comprise the third pass of the heat exchanger.

In transitioning from the third pass to the fourth pass, all of the third pass tubes enter E-bend connectors 76 to combine by pairs and then enter the inlets of fourth pass tubes. In transitioning from the third pass to the fourth pass, the number of tubes is therefore halved resulting in a pair of fourth pass tubes remaining in each pattern set 71. Therefore another step reduction 122 in the number of tubes in the heat exchanger is evident in FIG. 3B as the forty-eight tubes of the third pass are reduced to the twelve tubes of the fourth pass.

The remaining fourth pass tubes enter an E-bend connector 76 and combine into a single fifth pass tube thus results in a single fifth pass tube per pattern set 71 and a total of twelve fifth pass tubes in the heat exchanger as indicated by step 124.

For ease of manufacturing and to avoid having the exit of the pattern set 71 at a low point, a bypass connector 130 is used to connect the fifth pass to the sixth pass and raise it relative to a bottom 55 of the pattern. A conventional U-bend 74 connects the sixth pass to the seventh pass. After the seventh pass, the refrigerant exits the pattern set 71 in the heat exchanger.

FIG. 3C illustrates the pattern set 71 of FIG. 3 but in a two dimensional linear form without showing the actual doubling back across the face of the heat exchanger which occurs with each pass. From the pass numbers labeled across the top of FIG. 3C, it is readily apparent that the first and second passes of a pattern set 71 each have six tubes, and that the output of the second pass is reduced from six tubes to four tubes by combining the output of four of the second pass tubes. It is also apparent that each third pass tube is combined with another third pass tube to half the number of tubes entering the fourth pass. The same occurs when both of the fourth pass tubes are combined to result in a single fifth pass tube. The single fifth pass tube carries refrigerant to a single sixth pass tubes and on to a single seventh pass tube.

FIG. 3C illustrates the symmetrical nature of the pattern sets which balances the flow of refrigerant so that the flow through the overall coil is balanced. Refrigerant is evenly distributed in all of the tubes 60, and the pattern set 71 can be seen to be bilaterally symmetrical.

In FIG. 3D, the linear viewpoint of FIG. 3C is replicated into the twelve pattern sets 71 used in the seven pass heat exchanger of the preferred embodiment. Manufacturing is facilitated since the smaller pattern sets 71 are replicated until the heat exchanger is complete. The physical arrangement is shown and discussed with respect to FIG. 11.

FIG. 3E shows the third through fourth pattern sets II, III and IV of FIG. 3D of FIG. 3A from an end on viewpoint. It is evident from this viewpoint that the pattern sets 71 are basically stacked until the heat exchanger is complete. The overlaying of the fins 62 upon the tubes 60 unifies the tubes 60 into a single cohesive whole. This is discussed more in detail in the Kraay reference incorporated above.

FIGS. 4A–4E represent a further preferred embodiment for a five pass heat exchanger having tubes arranged into a pattern set 153. In the five pass embodiment, the patter set 153 includes eight tubes in an initial first pass (as shown by FIG. 4C) and placed in the arrangement shown in FIG. 4A. Half of the first pass tubes are combined by E-bends 76 as indicated by the areas 150 so that there are only six tubes in the second pass of the pattern set 153. Two-thirds of the second pass tubes are combined by E-bend connectors 76 as indicated by areas 152 so that the number of tubes remaining after the second pass and beginning the third pass is four in each pattern set 153. A special connecting tube 154 is used in transitioning the outlet of one of second pass tubes to the inlet of one of the third pass tubes. All of the third pass tubes exit into E-bend connectors 76 and combine when entering the fourth pass tubes as indicated by areas 158, effectively reducing the number of tubes in the fourth pass in half as compared with the third pass. These two remaining tubes are combined after the fourth pass by an E-bend connector 76 and enter a fifth pass.

The pattern set 153 of FIG. 4A has a total of eight tubes in the first pass and the five pass embodiment uses twelve pattern sets 153 as indicated by FIG. 4D. FIG. 4C represents a linear arrangement of FIG. 4A without the actual doubling back from pass to pass being illustrated. The second pass of each of the twelve pattern sets 153 includes only six tubes so there is a step down 180 from the ninety-six tubes of the first pass shown by the area 182 to the seventy-two tubes of the second pass shown by the area 184. There is another step down 186 to the forty-eight tubes of the third pass as illustrated by the area 188 and a further step down 190 to the twenty-four tubes of the fourth pass as illustrated by the area 192. A final step down 194 is illustrated by the twelve tubes of the fifth pass shown in the area 196.

FIG. 4C illustrates that the pattern set 153 is bilaterally symmetrical so that refrigerant flow is balanced through the coil and refrigerant is evenly distributed in all of the tubes. In the case of FIG. 4C, the top half of the pattern set 153 is a mirror image of the bottom half.

FIG. 4E illustrates a trio of the pattern sets 153 identified by Roman Numerals II, III and IV as assembled linearly to form a part of the twelve pattern sets used in the heat exchanger. The overall arrangement of these pattern sets is shown and discussed with regard to FIG. 11.

Similarly to the seven pass arrangement of FIGS. 3A through 3E and the five pass arrangement of FIGS. 4A through 4E, FIGS. 5A through 5E show a nine pass arrangement. The embodiments are generally similar, and the discussion of the nine pass arrangement will discuss the differences rather than repeat the similarities.

FIG. 5A shows the nine passes of the nine pass embodiment arranged in a pattern set 200. Referencing the linear arrangement of FIG. 5E and the end view arrangement of FIG. 5A, it can be seen that there are ten tubes in the first pass, four of which enter E-bend connectors 76 and reduce the number of tubes in each pattern set of the second pass to eight. These eight tubes each continue directly into a third pass through a U-bend connector 74. Four of the third pass tubes enter E-bend connectors 76 and combine into a pair of tubes to leave six tubes in the fourth pass. The uncombined tubes from the third pass are linked directly to the fourth pass by U-bend connectors 74 and these uncombined tubes combine by means of E-bend connectors 76 after the fourth pass to result in a pair of fifth pass tubes. With tubes linking directly from the fourth pass by connector 74, there are a total of four tubes in the fifth pass.

All of these tubes enter E-bend connectors 76 and combine to result in a pair of sixth pass tubes. The pair of sixth pass tubes are serially linked by U-bend connector 74 to a pair of seventh pass tubes. The seventh pass tubes enter an E-bend connector 76 and combine to result in an eighth pass tube which is in turn serially linked by a U-bend connector 74 to a single ninth pass tube.

The overall number of tubes is graphed in FIG. 5B. Twelve pattern sets 200 are used in forming a nine pass heat exchanger as shown in FIG. 5D. Thus the ten individual tubes of the first pass of each pattern set 200 and the twelve overall pattern sets is shown by the bar 300 in FIG. 5B indicating that there are a total of one hundred and twenty tubes in the first pass of the nine pass heat exchanger. There is a step down 302 to ninety-six tubes in the second pass of the pattern set 200 as shown by the area 304. The same number of ninety-six tubes is shown by the area 306 of the third pass, but there is a step down 308 resulting from the reduction to the seventy-two tubes of the fifth passes shown by area 310. A further step down 312 is shown by the area 314 representative of the forty-eight tubes of the fifth pass. Yet another step down 316 is shown by the reduction to the twenty-four tubes of the sixth passes represented by the area 318. There is no step between the sixth and seventh passes and thus the area 320 represents the twenty-four tubes of the seventh pass. The final reduction in the eighth pass to a single tube in each pattern set is shown by step 322 as represented by the area 324 of the eighth pass. The same number of twelve tubes is shown by area 326 of the ninth pass.

FIG. 5C is also bilaterally symmetrical to balance refrigerant flow through the coil and evenly distribute refrigerant in all of the tubes. The bilateral symmetry between the top half and the bottom half of the pattern set 200 is readily apparent.

In FIG. 5D, the linear viewpoint of FIG. 5C is replicated into the twelve pattern sets 200 used in the nine pass heat exchanger of the preferred embodiment. The pattern sets 200 are replicated into coils until the heat exchanger is complete. The physical arrangement is shown and discussed with respect to FIG. 10. Four coil slabs are used in this nine pass embodiment with three pattern sets 200 in each of the coil slabs. Airflow is shown as indicated by arrows.

FIG. 6B shows a second embodiment of the E-shaped connector of FIG. 6A where the pair of inlets 340 enter at the outer legs 340 and the center leg 342 acts as the outlet. This is illustrated by reference numeral 160 of FIG. 4A and reference numeral 344 of FIG. 5A.

Although the E-bend connectors 76 are shown in terms of a pair of inlets and a single outlet, a person of ordinary skill in the art will recognize that three or more inlets could be combined into an arrangement with a single outlet. FIG. 9 is an example of such a connector 350 having three inlet arms 352 each with its own inlet 354, and a central outlet arm 356 which provides a single outlet 358. With a connector 350, a step circuit with a 3 to 1 reduction in tubes from pass to pass can be accomplished.

Figure 10:
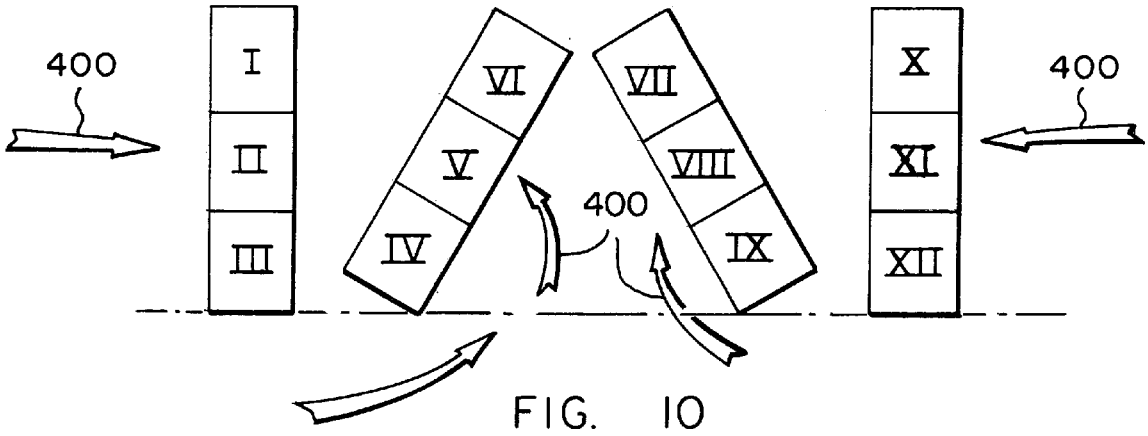
FIG. 10 shows the coil arrangement for the heat exchanger taken along lines 10—10 of FIG. 2 in the nine pass arrangement used in FIGS. 5A–5E.

FIG. 10 shows the nine pass arrangement preferred with regard to FIGS. 5A–5E and referencing the Roman Numeral pattern sets I-XII. These coils are in the arrangement of U.S. Pat. No. 5,067,560 to Carey, previously incorporated by reference. Airflow direction is shown by arrows 400.

Figure 11:
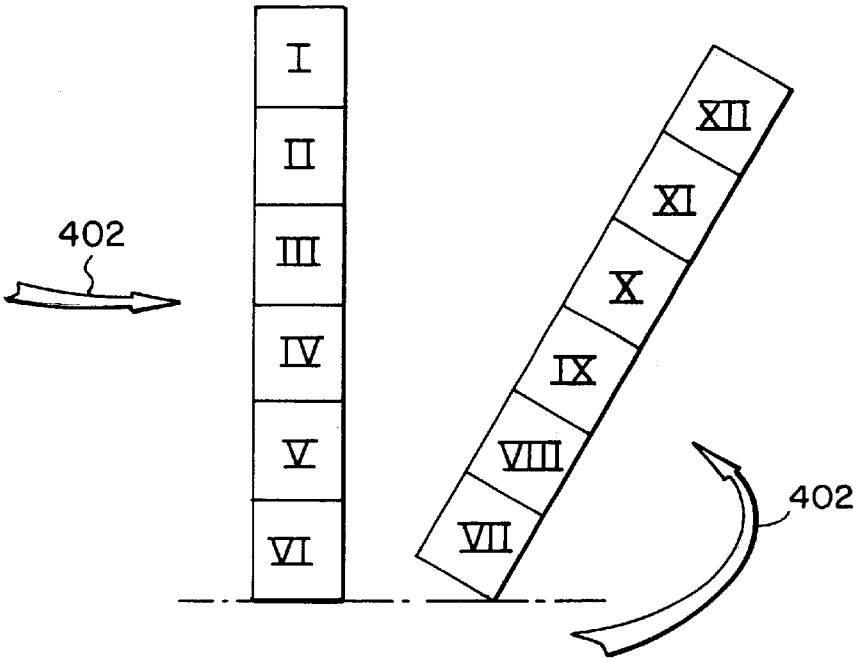
FIG. 11 shows the coil arrangement for the heat exchanger taken along lines 11—11 of FIG. 2 as used in the seven pass arrangement of FIGS. 3A–3E and the five pass arrangement of FIGS. 4A–4E.

FIG. 11 shows the preferred coil arrangement for the pattern sets 71 of FIGS. 3A–3B and the pattern set 153 used in the five pass heat exchanger of FIGS. 4A–4E. Six pattern sets 71, 153 are replicated in a vertical coil while six pattern sets 71, 153 are replicated in a tilted coil slab. The arrows 402 shows the direction of airflow.

What has been shown is a step circuiting arrangement for a heat exchanger which provides low pressure at an initial pass and increased refrigerant velocity and heat transfer coefficient at subsequent passes. It will be apparent to a person of ordinary skill in the art that many changes and variations are possible. The linear E-bend connector of FIG. 6 could be made non-linear including a V-shape where the inlets and outlet are located at the point of the "V" and at the ends of the "V" arms. Also, the variation shown in FIG. 9 could be modified in many ways including the addition of further arms and inlets and including changing the outlet and inlets to a non-planar arrangement. Additionally, the five, seven and nine pass arrangements of FIGS. 3–5 are preferred embodiments but are also merely exemplary of the ways in which the present invention could be implemented. More pattern sets and combinations of pattern sets will be readily apparent to a person of ordinary skill in the art. All such modifications, variations and alterations are contemplated to fall within the spirit and scope of the claimed invention.

What is claimed for Letters Patent of the United States is set forth as follows.

What is claimed is:

1. A heat exchanger comprising:

a plurality of longitudinally extending tubes of substantially constant diameter grouped into at least first, second and third passes;

the tubes in the first pass being serially connected with tube in the second pass;

the tubes in the second pass being serially connected with tubes in the third pass; and a connector interconnecting the first pass with the second pass wherein the connector includes first and second inlets and a single outlet; and wherein the number of tubes in the first pass is greater than the number of tubes in the third pass;

wherein the first and second inlet are respectively located on a first and second inlet arm portions of the connector and the outlet is located on an outlet arm portion of the connector; and wherein the first and second inlet arm portions and the outlet portions lie in a common plane.

2. The heat exchanger of claim 1 wherein the connector has the shape of a capital "E".

3. A heat exchanger comprising:

a plurality of longitudinally extending tubes of substantially constant diameter grouped into at least first, second and third passes;

the tubes in the first pass being serially connected with tubes in the second pass;

the tubes in the second pass being serially connected with tubes in the third pass;

an E-shaped connector located between the tubes of two different passes;

wherein the number of tubes in the first pass is greater than the number of tubes in the third pass;

wherein the heat exchanger has a face, wherein the plurality of tubes are arranged in pattern sets, and each pattern set includes at least the first, the second and the third pass across the face of the heat exchanger, wherein the arrangement of tubes comprising each pattern set is symmetrical and wherein each pattern set includes all commonly connected tubes between an inlet manifold and an outlet manifold and wherein the heat exchanger includes at least two arrangements of each pattern set.

4. The heat exchanger of claim 3 wherein the number of tubes in a given pass is less than or equal to the number of tubes in a previous pass and wherein the heat exchanger includes at least two passes with differing numbers of tubes.

5. An air cooled heat exchanger comprising:

a frame;

a longitudinally extending heat exchanger surface arranged in the frame and supported thereby, the heat exchanger having an inlet, an outlet, and a plurality of parallel tubes having an inlet and an outlet and arranged in a pattern set;

a fan moving air through the heat exchanger surface;

a manifold distributing fluid from the inlet to the first pattern set;

a first pass of tubes in the pattern set;

a second pass of tubes in the pattern set;

a third pass of tubes in the pattern set; E-shaped, planar connectors transferring fluid from the some of the outlets of the first pass to the inlets of the second pass, and from the some of the outlets of the second pass to the inlets of the third pass;

wherein the number of tubes in the first pass is greater than or equal to the number of the tubes in the second pass; and wherein the number of tubes in the second pass is greater than or equal to the number of tubes in the third pass; and wherein the number of tubes in the first pass is greater than the number of tubes in the third pass.

6. The heat exchanger of claim 5 wherein at least one of the connectors has an E-shape.

* * * * *

UNITED STATES PATENT AND TRADEMARK OFFICE

CERTIFICATE OF CORRECTION

PATENT NO. : 6,382,310 B1
DATED : May 7, 2002
INVENTOR(S) : Sean A. Smith

It is certified that error appears in the above-identified patent and that said Letters Patent is hereby corrected as shown below:

Column 11,
Line 4, “from the some of” should read -- from some of --.
Line 6, “from the some of” should read -- from some of --.

Signed and Sealed this

Ninth Day of July, 2002

*Attest:*

*Attesting Officer*

JAMES E. ROGAN
*Director of the United States Patent and Trademark Office*